United States Patent [19]

Berry

[11] 4,005,501

[45] Feb. 1, 1977

[54] MOUNTING MEANS FOR THE ROTATABLE BRUSH ROLL OF A SUCTION CLEANER

[75] Inventor: Willis E. Berry, Bloomington, Ill.

[73] Assignee: National Union Electric Corporation, Greenwich, Conn.

[22] Filed: May 27, 1975

[21] Appl. No.: 580,559

[52] U.S. Cl. ..... 15/339; 15/392

[51] Int. Cl.[2] ..... A47L 5/30

[58] Field of Search ..... 15/389, 339, 390, 391, 15/392

[56] References Cited

UNITED STATES PATENTS

| | | | |
|---|---|---|---|
| 1,903,794 | 4/1933 | Richardson et al. | 15/392 X |
| 1,995,630 | 3/1935 | Bass | 15/392 X |
| 2,216,709 | 10/1940 | Langille | 15/392 X |
| 2,607,069 | 8/1952 | Hahn | 15/392 X |
| 2,707,792 | 5/1955 | Waller | 15/392 X |
| 3,639,941 | 2/1972 | Kirwan | 15/389 X |

*Primary Examiner*—Christopher K. Moore
*Attorney, Agent, or Firm*—Hibben, Noyes & Bicknell

[57] ABSTRACT

A mounting means for supporting and positioning the elongated brush roll of a suction cleaner in the suction chamber or nozzle of the cleaner so that the brush roll may be rapidly and easily mounted in or removed from the suction chamber. Guide and bearing surfaces are defined on a plurality of bosses on the portion of each side wall of the cleaner base which defines the suction chamber, and the external surfaces on a hexagonal boss at each end of the brush roll coact with the guide surfaces on the bosses to guide the direction of movement of the brush roll during installation and removal thereof from the suction chamber and with the bearing surfaces on the bosses to locate the brush roll in its operating position in the suction chamber. The guide surfaces are inclined toward the rear of the cleaner base so that the brush roll is held in its operating position in the suction chamber solely by the tension of the brush roll drive belt.

12 Claims, 8 Drawing Figures

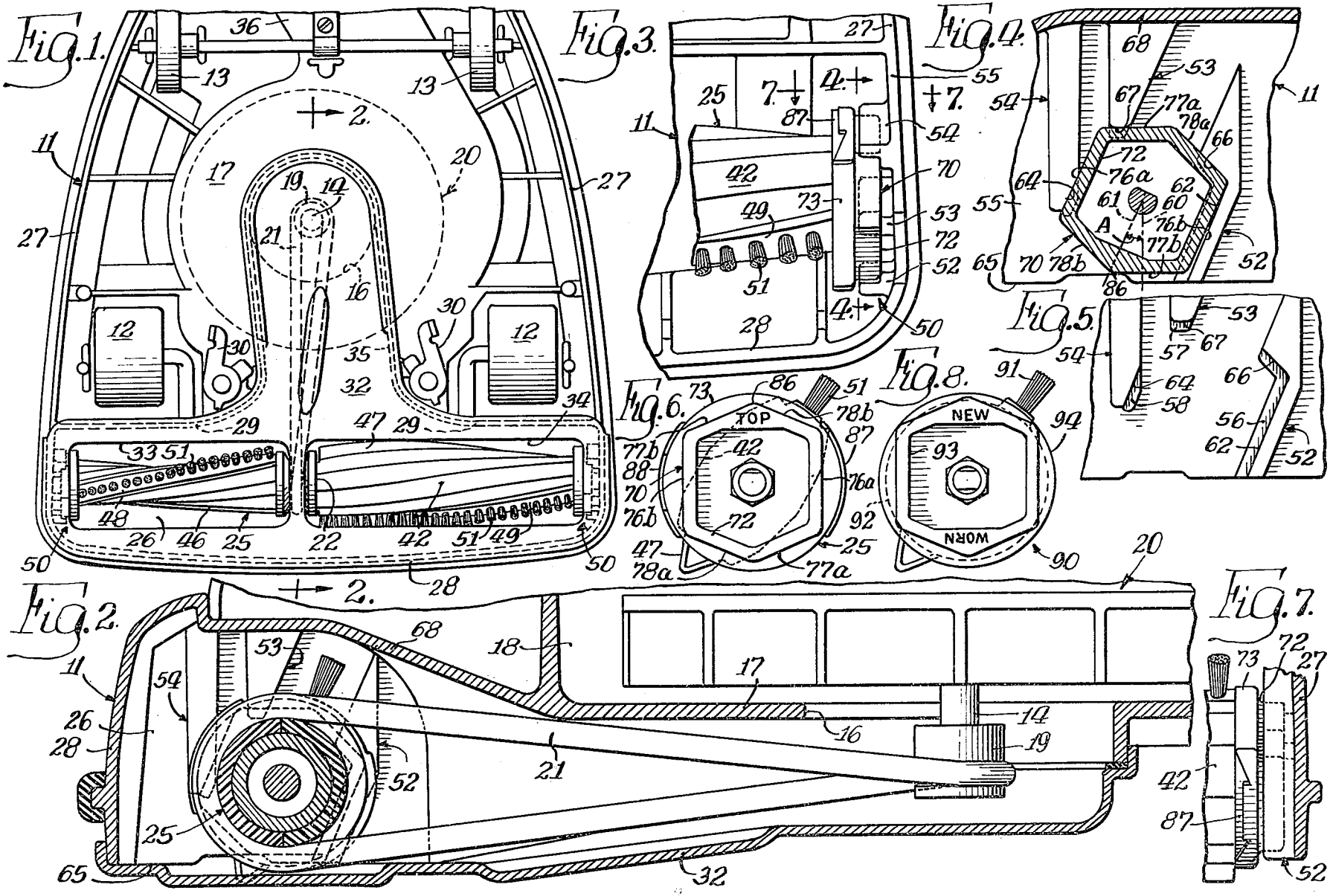
FIG. 1.
FIG. 2.
FIG. 3.
FIG. 4.
FIG. 5.
FIG. 6.
FIG. 7.
FIG. 8.
NEW
WORN
TOP

MOUNTING MEANS FOR THE ROTATABLE BRUSH ROLL OF A SUCTION CLEANER

This invention relates to a suction cleaner, and more particularly relates to an improved mounting means for supporting and positioning a rotatable brush roll in the suction chamber or nozzle of a suction cleaner.

Various types of mounting structures have been heretofore advanced for receiving and supporting a rotatable brush roll or agitator in the suction chamber or nozzle of a suction cleaner so that the brush roll could be easily installed in or removed from the suction chamber or nozzle of the cleaner for purposes of inspection, cleaning and/or replacement. Moreover, many of the mounting structures heretofore advanced depended upon the tension in the drive belt for the brush roll to hold the latter in its operating position in the suction nozzle or chamber of the cleaner. One example of the latter type of mounting arrangement is disclosed in the Watts U.S. Pat. No. 2,039,860.

Many of the mounting structures heretofore developed also took into account the shortening of the bristles of the brush roll or agitator with extended use and included additional structure for positioning the brush roll closer to the suction opening in the nozzle or body of the cleaner to compensate for the wear of the bristles. While the mounting structure disclosed in the Watts patent was capable of performing the aforementioned wear compensation function, the adjustment of the position of the brush roll in the nozzle of this cleaner required careful adjustment of nuts threaded into the nozzle housing. Adjustment of the position of the brush roll of the Watts cleaner was, therefore, both time consuming and difficult.

In order to simplify and facilitate mounting of the brush roller or agitator in different positions in the suction chamber or nozzle of its associated cleaner, many of the prior art mounting arrangements employed non-circular structures on the outer ends of the brush rolls for engaging complementally-shaped seats or brackets in the nozzles of the cleaners, the axis of the brush roll being eccentric to the geometric center of the non-circular engaging structures. Specifically, hexagonal-shaped engaging structures, such as are disclosed in Carlson U.S. Pat. No. 2,192,397 and the Ashbaugh U.S. Pat. No. 2,233,762, were employed for this purpose. However, the seat or receiving structures for the hexagonal engaging structures of these cleaners were either formed in large thickened portions of the side wall of the cleaner nozzle or hosing, which was an expensive construction, or were provided by brackets having spring arms which frictionally engaged the hexagonal engaging structures on the ends of the brush rolls of these cleaners and which made installation and removal of the brush rolls of these cleaners difficult.

In addition to the foregoing types of brush roll mountings, efforts have also been made to mount the rotatable brush roll in the nozzle of a suction cleaner so that the brush roll could move toward and away from the base plate of the cleaner so that the extent to which the beater bars ad bristles of the brush roll extended through the suction inlet in the base plate would vary in accordance with the texture and thickness of the rug or carpet being cleaned. Such mounting utilized the tension in the brush roll drive belt to exert a continuous biasing force on the brush roll tending to shift it to its lowermost position in the nozzle. A mounting arrangement of the foregoing character is disclosed in the Kirwan et al. U.S. Pat. No. 3,639,941. However, the brush roll mounting arrangement disclosed in the Kirwan et al patent was prone to cause premature wear of the bristles of the brush roll as well as the rug or carpet being cleaned.

Accordingly, it is a general object of the present invention to provide a novel and improved mounting means for the rotatable brush roll or agitator of a suction cleaner.

Another object is to provide a novel mounting means of the foregoing character, which permits rapid and easy removal and installation of the brush roll from its operating position in the suction chamber or nozzle of the cleaner.

A more particular object is to provide a novel mounting means for the rotatable brush roll of a suction cleaner, wherein a plurality of bosses having bearing and guide surfaces are provided on the side walls of the cleaner base, specifically in the suction chamber of the cleaner, and wherein a generally hexagonally shaped boss is provided on each end of the brush roll for engaging the bearing and guide surfaces.

A specific object is to provide a novel brush roll mounting means of the foregoing character, wherein the guide surfaces in the suction chamber of the cleaner slant upwardly and rearwardly from the lower marginal edges of the cleaner base and wherein the tension in the brush roll drive belt is utilized to hold the hexagonally-shaped bosses on the ends of the brush roll engaged with the bearing and guide surfaces on the side walls.

A further object is to provide a novel mounting means for the brush roll of a suction cleaner, which is simple in construction, reliable in operation, and utilizes fewer parts and less material than prior art constructions.

These and other objects will become apparent from the following detailed description and accompanying drawing, wherein:

FIG. 1 is a bottom plan view of the base of an upright suction cleaner employing a mounting arrangement for the rotatable brush roll or agitator thereof embodying the features of the present invention;

FIG. 2 is an enlarged, broken, longitudinal sectional view taken substantially along the line 2—2 of FIG. 1;

FIG. 3 is a fragmentary bottom plan view of a portion of the suction cleaner illustrated in FIG. 1 but with the sole plate removed to show additional details of the brush roll mounting means;

FIG. 4 is a transverse sectional view taken along the line 4—4 of FIG. 3;

FIG. 5 is a view similar to FIG. 4 but with the brush roll removed to show additional details of the socket portion or seat of the mounting means;

FIG. 6 is an elevational view of one end of the brush roll illustrated in FIGS. 1 and 3 and showing additional details of the structure at the end of the brush roll that engages the socket portion or seat of the mounting means;

FIG. 7 is a fragmentary elevational view, taken substantially along the line 7—7 of FIG. 3, and showing the structure on the bearing caps of the brush roll illustrated in FIGS. 1 and 3 which facilitates indexing of the engaging structure of the mounting means with the socket portion; and FIG. 8 is an end elevational view of another brush roll embodying the features of the present invention.

In FIG. 1, the underside of the base of an upright suction cleaner is illustrated, such base being indicated generally at 11. Two pairs of wheels 12 and 13 are respectively mounted adjacent the front and rear ends of the cleaner to facilitate movement of the cleaner over a surface to be cleaned. A pivotally mounted handle (not shown) is attached to the rear of the cleaner to permit manipulation thereof over the surface being cleaned.

A drive motor (also not shown) is mounted on the base 11 so that its drive shaft 14 (FIGS. 1 and 2) extends vertically downwardly through an opening 16 in a horizontal wall portion 17 in the base 11 and comprising a portion of a fan chamber 18 in the cleaner. Suction generating means in the form of a centrifugal fan 20 is secured to the shaft 14 for rotation in the chamber 18. A pulley 19 is secured to the lower end of the drive shaft 14 and a belt 21 extends around the pulley 19 and another pulley 22 for rotating an elongated brush roll assembly or agitator 25 that is rotatably mounted in an elongated suction chamber or nozzle 26 in the base 11. The base 11 also includes laterally spaced side walls 27, a front wall 28, and a pair of laterally extending, intermediate wall portions 29, which are spaced rearwardly from and are substantially parallel to the front wall 28.

The suction chamber 26, in the present instance, is defined in part by portions of the laterally spaced side walls 27, the front wall 28, and the laterally extending, intermediate wall portions 29 of the base 11. A sole plate 32 is detachably secured to the underside of the base 11 by swingable latches 30 and is provided with a pair of elongated, generally rectangularly-shaped openings 33 and 34 therein, which together define the suction opening of the cleaner through which dirt and other materials are drawn when the cleaner is in operation.

After passing through the openings 33 and 34, air in the suction chamber 26 flows rearwardly through a connecting passage 35 to the central inlet 16 of the fan chamber 18 and is discharged therefrom through a tangential outlet 36 (FIG. 1) which is connected to a filter bag (not shown).

The brush roll assembly 25 is described in detail and claimed in the Schaefer et al. U.S. Pat. No. 3,683,444, issued Aug. 15, 1972, and assigned to the assignee of this application. Reference should therefore be made to the aforementioned Schaefer patent for a more detailed description of the construction of the brush roll assembly 25. However, for the purposes of the description of the present invention, it will suffice to state that the brush roll assembly 25 comprises an elongated roll body member 42, which may be of metal and which is twisted about its longitudinal axis so as to be of helical form. The pulley 22 is secured generally centrally to the roll body member 42, and two pairs of grooves are provided in the side edges of the roll body member 42 for receiving a pair of beater elements 46 and 47 and a pair of replaceable brush strip members 48 and 49, respectively. Each of the brush strip members 48 and 49 is provided with a plurality of bundles of bristles 51 which shorten with use and which are replaced by replacement of the entire brush strip. The manner in which the brush strips 48 and 49 of the brush roll assembly 25 are retained in, removed from and replaced with new strips is also described in detail and claimed in the aforementioned Schaefer et al. U.S. Pat. No. 3,683,444.

Referring now to FIGS. 3, 4, 5 and 6 in conjunction with FIGS. 1 and 2, a novel mounting means, indicated generally at 50, for receiving and supporting each end of the brush roll assembly 25 in the suction chamber 26 and embodying the features of the present invention, will now be described. Since the mounting means 50 at each end of the brush assembly are identical, only one will be described in detail. The mounting means 50 thus comprises a socket means or seat on the inner sides of the portions, indicated at 55, of the side walls 27 which define the suction chamber 26, and engaging means, indicated at 70, at the end of the brush roll for engaging the socket means or seat.

The socket means or seat of the mounting means 50, in the present instance, comprises at least one and preferably three, laterally inwardly extending boses 52, 53 and 54 on the side wall portions 55, which are recessed or undercut to define a bearing surface on each of the bosses for limiting axial movement of the brush roll assembly 25 in the suction chamber 26. The axial bearing surface of the boss 52 is indicated at 56 and has a dog-leg configuration, while the bearing surfaces on the bosses 53 and 54 are indicated at 57 and 58, respectively, and are generally rectangular in configuration. The bearing surfaces 56, 57 and 58 are spaced a sufficient distance from the side wall portions 55 so that the brush roll assembly 25 does not contact the side wall portions 55 when mounted in the mounting means 50.

The laterally extending, parallel surface portions, indicated at 62 and 64, on the bosses 52 and 54 comprise guide surfaces which coact with the engaging means 70 at the end of the brush roll assembly 25 to guide the direction of movement thereof as the latter is shifted radially relative to the base 11 and also to cause the brush roll assembly 25 to be biased upwardly and inwardly toward its operating position in the suction chamber 26 as a result of the tension in the drive belt 21, the line of action of the drive belt tension force being substantially parallel to the plane of the base 11. To this end, the guide surfaces 62 and 64 lie in parallel planes which are inclined upwardly and rearwardly from the lower marginal edge, indicated at 65 in FIGS. 2 and 4, of the base 11. Such angle of inclination is indicated in FIG. 4 by the angle A between the line 60, which is perpendicular to the plane of the base 11, and the line 61, which is parallel to the guide surfaces 62 and 64. The angle A may be in the range of from about 20° to 30°, an angle of 23° being preferred.

Radially inward shifting movement of the brush roll assembly 25 is limited by stop means provided by the laterally extending bearing surface portion, indicated at 66, of the boss 52 and the laterally extending surface portion, indicated at 67, of the boss 53. Thus, one or the other or both of the surface portions 66 and 67 comprise another bearing surface for limiting radially inward shifting movement of the brush roll assembly 25 toward the upper wall, indicated at 68 in FIGS. 2 and 4, of the base 11.

As previously mentioned, mounting means 50 includes the engaging means 70 on each end of the brush roll assembly 25. The engaging means 70, in the present instance, preferably comprises a generally hexagonally-shaped boss 72 formed integrally with and extending axially outwardly from the outer end face of a bearing support member or cap 73 on the outer end of the brush roll body 42. The boss 72 is preferably hollow and includes at least two and, in the present instance, three pairs of parallel surfaces on the outer periphery thereof. Such pairs of parallel surfaces are indicated at 76a and 76b, 77a and 77b, and 78a and 78b, respectively. The transverse distance between one of the three pairs of parallel surfaces, in this instance the parallel surfaces 76a and 76b, is less than the transverse distance between the other pairs of parallel surfaces and is substantially equal to the transverse distance between the guide surfaces 62 and 64 of the bosses 52 and 54, respectively. Consequently, the boss 72, and therefore the brush roll assembly 25, can only be shifted into its seated position in the suction chamber 26 when the surfaces 76a and 76b on the boss 72 are parallel with the guide surfaces 62 and 64 on the bosses 52 and 54, or vice versa.

As heretofore mentioned, the laterally extending surface portions 66 and 67 of the bosses 52 and 53, comprise bearing surfaces or stops for limiting radially inward shifting movement of the boss 72 and, consequently, the brush roll assembly 25 toward the upper wall 68 of the base 11. To this end, the surface portions 66 and 67 are preferably formed so as to lie in planes parallel with those of the surface portions 77a and 78a or 77b and 78b when one or the other of the latter pairs of surfaces are engaged with the bearing surfaces 66 and 67. In FIG. 4, the surfaces 78a and 77a are shown engaged with the surfaces 66 and 67 of the bosses 52 and 53, respectively.

In order to assist a user of a cleaner incorporating the mounting means 50 to properly orient the surfaces 76a and 76b on the boss 72 with the guide surfaces 62 and 64, indicia may be provided on one or the other or both end faces of the bosses 72 for this purpose. Such indicia, in the present instance, comprises the word TOP on the boss 72 adjacent one, indicated at 86, of the two corners of the boss 72 which are centrally disposed between the surfaces 76a and 76b.

In order to further assist a user in properly orienting the boss 72 with the guide surfaces 62 and 64 when the brush roll assembly is being installed in the suction chamber 26 of the base 11, additional indexing means in the form of a pair of double-ended, circumferentially extending arrows, respectively indicated 87 and 88, may be embossed on the outer periphery of the bearing support cap 73 so as to be in general axial alignment and coextensive with the transversely spaced sides of the boss 72 adjacent to the surfaces 76a and 76b. Thus, one or the other of the arrows 87 and 88 will be visible and generally parallel with the boss 52 when the brush roll assembly 25 is properly oriented for engagement with the bosses 52, 53 and 54.

Since the brush strips 48 and 49 employed in the brush roll assembly 25 may be replaced as a unit when the bristles 51 thereof become worn, the engaging means 70 for the brush roll assembly 25 does not make provision for causing the axis of the roll body member 42 to be shifted closer to the suction openings 33 and 34. Consequently, the geometric center of the boss 72 is coincident with the axis of rotation of the brush roll body 42.

However, if a brush roll assembly, such as the brush roll assembly 90 having bundles of bristles, indicated at 91, which are permanently secured in spirally arranged openings in a cylindrical body 92, is utilized instead of the brush roll assembly 25, then the engaging means or hexagonal boss, indicated at 93 in FIG. 8, on the outer surface of the bearing retainer cap 94 of the assembly 90 is arranged so that the geometric center of the boss 93 is eccentric with respect to the axis of rotation of the cylindrical body 92.

With the foregoing construction, it will be apparent that the mounting means of the present invention permits rapid and simplified installation and removal of the rotatable brush roll assembly from the suction chamber or nozzle or a suction cleaner and also rigidly supports the brush roll assembly in the suction chamber. The multiple boss construction employed in the mounting means results in a savings in material and, since the guide surfaces on the support bosses are inclined upwardly and rearwardly in the cleaner bases, the tension in the brush roll drive belt is sufficient to hold the brush roll engaged with the bearing and guide surfaces on the support bosses without the necessity of additional retaining structure. Such construction also results in a reduction in the overall cost of the cleaner.

I claim:

1. In a suction cleaner including a base having front, rear and laterally spaced side walls, said base having an elongated suction chamber therein and extending laterally thereof, said suction chamber being defined in part by portions of said laterally spaced side walls and a sole plate, and said sole plate having at least one elongated, laterally extending suction opening therein, the improvement of mounting means for supporting and positioning an elongated, rotatable brush roll in said suction chamber and permitting said brush roll to be rapidly and easily mounted in or removed from said suction chamber, said mounting means comprising at least a pair of bosses carried on each of said laterally spaced side wall portions of said suction chamber, the bosses of each pair having a bearing surface for limiting axial movement of said brush roll in said suction chamber, the bosses of each pair also defining a pair of spaced guide surfaces for guiding movement of said brush roll into and out of said suction chamber so that said brush roll is radially shiftable in substantially only one plane, and one of the bosses of each pair having another bearing surface for limiting radially inward shifting movement of said brush roll, and engaging means formed on the ends of said brush roll for directly engaging said bearing and guide surfaces.

2. The suction cleaner of claim 1, in which another boss is provided on each of said side wall portions, said other boss having a bearing surface coacting with said other bearing surface on said one boss of each pair to limit radially inward shifting movement of said brush roll.

3. The suction cleaner of claim 1, in which said guide surfaces slant upwardly and rearwardly from the lower marginal edges of said side wall portions by an angle of between about 20° to 30° from a plane perpendicular to the plane of said base.

4. The suction cleaner of claim 3, in which the angle of rearward slant of said guide surfaces is about 23°.

5. The suction cleaner of claim 3 in which a drive motor having an output shaft and a drive pulley is mounted on said base, a pulley is provided on said brush roll, and an endless belt under tension extends around said drive pulley and said pulley, the line of action of the force on said brush roll from the tension in said belt being substantially parallel to the plane of said base, whereby said brush roll is retained against said bearing and guide surfaces.

6. In a suction cleaner including a base having front, rear and laterally spaced side walls, said base having an elongated, laterally extending suction chamber therein, said suction chamber being defined in part by laterally spaced portions of said side walls and a removable sole plate having at least one suction opening therein, the improvement of mounting means for supporting an elongated, rotatable brush roll in said suction chamber and permitting rapid installation in and removal of said brush roll therefrom, said mounting means comprising means defining a seat on the inner surfaces of said suction chamber side wall portions, each seat having a pair of spaced, parallel guide surfaces and stop means for limiting radial inward shifting movement of said bursh roll, and engaging means formed on each end of said brush roll for directly engaging said guide surfaces and said stop means, said guide surfaces and said engaging means coacting so that said engaging means is movable between said guide surfaces in one or the other of two diametrically oppositely oriented positions.

7. The suction cleaner of claim 6, in which said engaging means comprises a boss at each end of said brush roll and having at least two pairs of parallel surfaces, the transverse distance between one of said pairs of parallel surfaces being substantially equal to the distance between the parallel guide surfaces of said seat, and the transverse distance between the other of said pairs of parallel surfaces on said brush roll boss being greater than the distance between said guide surfaces.

8. The suction cleaner of claim 7 in which said boss has another pair of parallel surfaces, the tranverse distance between said other pair of parallel surfaces also being greater than the distance between said parallel guide surfaces.

9. The suction cleaner of claim 8, in which indicia is provided on said brush roll boss to facilitate alignment of said one pair of parallel surfaces thereof with said guide surfaces of said seat.

10. The suction cleaner of claim 9, in which said brush roll boss has a plurality of corners, one of said corners is disposed centrally between said one pair of parallel surfaces, and said indicia is located adjacent to said one corner.

11. The suction cleaner of claim 9, in which said brush roll boss has a plurality of transversely spaced sides, one pair of parallel surfaces is provided on two of the transversely spaced sides of said brush roll boss, said brush roll boss is carried on the outer side of a bearing support member disposed at each end of said brush roll, and additional indicia is provided on said bearing support member to facilitate alignment of said one pair of parallel surfaces of said brush roll boss with said guide surfaces of said seat.

12. The suction cleaner of claim 11, in which said bearing support member includes a circular cap portion, and said additional indicia comprises at least one circumferentially extending, double-ended arrow on said cap portion, said arrow being in axial alignment and coextensive with one of the transversely spaced sides of said brush boss.

* * * * *